United States Patent [19]

Kerr

[11] 3,975,799

[45] Aug. 24, 1976

[54] ANCHORAGE ASSEMBLY FOR USE IN THE PRESTRESSING OF CONCRETE STRUCTURES

[75] Inventor: Robert Michael Kerr, Leeds, England

[73] Assignee: CCL Systems Limited, Surbiton, England

[22] Filed: Aug. 13, 1974

[21] Appl. No.: 497,125

[30] Foreign Application Priority Data

Aug. 23, 1973 United Kingdom ..... 39936/73

[52] U.S. Cl. ..... 24/122.6; 24/115 M; 52/230; 403/369

[51] Int. Cl.[2] ..... F16G 11/04

[58] Field of Search ..... 24/115 M, 122.6; 403/369, 368; 52/230, 223 L; 339/248 S

[56] References Cited

UNITED STATES PATENTS

| | | | |
|---|---|---|---|
| 2,025,556 | 12/1935 | Stahl | 24/115 M |
| 3,327,380 | 6/1967 | Howlett | 24/122.6 |
| 3,658,296 | 4/1972 | Yegge | 24/122.6 |
| 3,833,706 | 9/1974 | Edwards | 24/122.6 |

FOREIGN PATENTS OR APPLICATIONS

| | | | |
|---|---|---|---|
| 204,180 | 11/1956 | Australia | 403/374 |
| 218,602 | 10/1958 | Australia | 24/115 M |
| 406,943 | 2/1968 | Australia | 24/115 M |
| 1,517,292 | 2/1968 | France | 52/230 |
| 1,373,624 | 8/1964 | France | 403/369 |
| 268,656 | 6/1964 | Netherlands | 52/230 |
| 894,240 | 4/1962 | United Kingdom | 52/230 |

*Primary Examiner*—Bernard A. Gelak
*Attorney, Agent, or Firm*—Baldwin, Wight & Brown

[57] ABSTRACT

This invention relates to a so-called live anchorage for use in the prestressing of concrete structures, the stressing element being anchored in a hole having a frusto-conical portion and a cylindrical portion by means of a frusto-conical wedge device, the leading or narrow end of said wedge device being such that it extends into said cylindrical portion.

7 Claims, 2 Drawing Figures

ANCHORAGE ASSEMBLY FOR USE IN THE PRESTRESSING OF CONCRETE STRUCTURES

Figure 1:
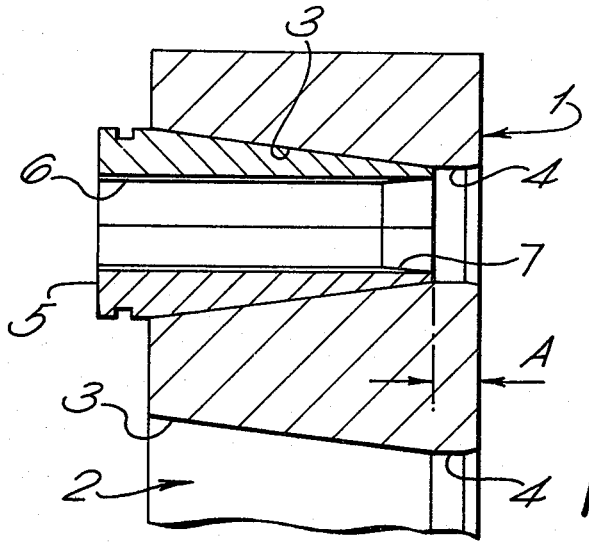

This invention relates to an improved anchorage assembly for use in the prestressing of concrete structures using strand.

The invention is concerned particularly with a so-called live anchorage assembly for a multi-strand tendon of the kind comprising a bearing plate or the like which is provided to bear, directly or indirectly, against a surface of a concrete structure, the bearing plate having a plurality of openings therethrough the axes of which lie parallel to one another and each of which is arranged to receive a stranded stressing element. Each opening consists of a frusto-conical portion extending over a major proportion of the thickness of the bearing plate and a cylindrical portion extending over the remaining part of the bearing plate and provided, in use, to be adjacent the face of the concrete structure. A two or more part frusto-conical wedge device is received in said opening to surround, in use, the stressing element, the arrangement being such that, when the stressing element is under load, the wedge device is drawn into the frusto-conical portion of the opening and is forced into gripping engagement with the stressing element.

In anchorage assemblies of the aforementioned kind it has always been the practice, and has always thought to be necessary, to arrange the relative sizes of the wedge devices and the openings so that the leading or narrow end of the wedge device does not extend beyond the leading or narrow end of the frusto-conical portion of the opening in the bearing plate. In other words, the leading end of the wedge device does not extend into the cylindrical portion of the opening where it would be unsupported.

In prestressing a concrete structure, it is usual to provide a stressing tendon consisting of a plurality of stranded stressing elements which are received individually in a corresponding number of radially and circumferentially spaced holes in the bearing plate. The area covered by the openings in the bearing plate is greater than the cross-sectional area of the duct in the concrete structure and therefore, depending upon the distance of the openings from the axis of the duct, the axes of the stressing elements will be caused to deviate from the axes of the openings to varying degrees, usually up to a maximum of 5°.

Tests have shown that the aforementioned anchorage assembly has difficulty in meeting the recently introduced revised British Standard Specification No. 4447, and the standards laid down by the Federation Internationale de la Preconstrainte on recommendations and acceptance of posttensioning systems (1972), concerning the static and dynamic requirements of anchorages. In applying the required load to the stressing elements, it was found that continued loading of the elements resulted in premature shear failure thereof instead of the more normal tensile failure found in straight anchorages, i.e. anchorages where there is no deviation of the stressing elements. It was thought automatically that this was due to the radial loads applied by the wedge devices and therefore steps were taken to increase the length of the wedge devices at the larger ends thereof. Further tests showed that this resulted in a very small increase in efficiency but this increase was still not enough to meet the requirements. It was then found, despite the fact that it had previously been thought that shear failure due to the side loads applied to the stressing elements, which side loads result in undue stress concentration on the stressing elements at their points of deviation, had been overcome by relieving the bore of the wedge device for approximately 20% of the grip length, that the side loads were still responsible for shear failure.

It is therefore among the objects of the present invention to provide an anchorage assembly which is such as to further reduce the effects of the aforementioned shear loads to a minimum.

According to the present invention, there is provided an anchorage assembly comprising a bearing plate having a plurality of transverse openings each of which is adapted to receive a stranded stressing element and each of which in the position of use in a stressed concrete structure, lies at an angle to the axis of its co-acting stressing element at the point where said element emerges from the bearing plate, a multi-part wedge device positioned between the wall of each opening and its co-acting stressing element, each opening being in the form of a frusto-conical portion and a cylindrical portion in continuation thereof, wherein the relative sizes of each opening and its co-acting wedge device are such that the leading or narrow end of the wedge device extends into the cylindrical portion of the opening.

Preferably, the axes of the transverse openings lie parallel to one another, and perpendicular to the face of the bearing plate.

Figure 2:
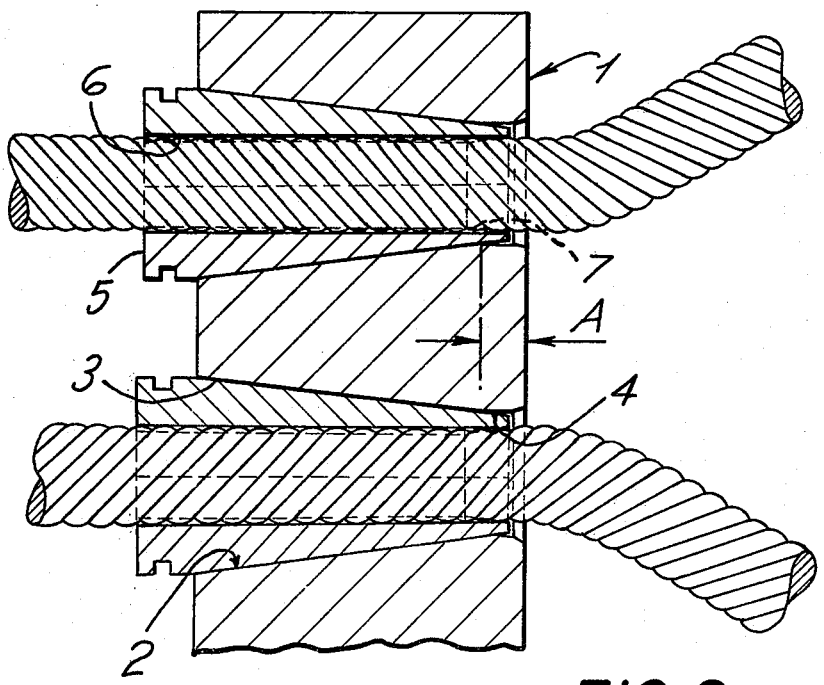

The invention is illustrated by way of example in the accompanying drawing in which, FIG. 1 shows a section through a traditional anchorage assembly, and FIG. 2 shows a corresponding section through an anchorage assembly according to the present invention.

Referring to the drawing, an anchorage assembly comprises a bearing plate 1 having a plurality of transverse openings 2, the axes of which lie parallel to one another and perpendicular to the face of the bearing plate. Each opening 2 consists of a frusto-conical portion 3 extending over a major portion of the thickness of the bearing plate 1 and a cylindrical portion 4 extending over the remaining portion of said thickness which is indicated by the arrows A.

A two or more part frusto-conical wedge device 5 is received within the opening 2, the wedge elements being formed internally with serrations 6 or the like to provide a gripping surface to engage the strand which passes therethrough coaxially with the opening 2. At the leading or narrow end of the device 5, the bore thereof is relieved or tapered at 7.

As can be seen in FIG. 2, the leading or narrow end of the wedge device 5 is arranged so that it extends into the cylindrical part 4 of the opening 2 and is, at least initially, unsupported by the wall of the opening 2. In this respect, it will be seen from FIG. 1 that the traditional arrangement is such that the leading or narrow end of the wedge device 5 is arranged so that it extends only over the frusto-conical portion 3 of the opening 2 and is therefore wholly supported by the wall of the opening 2. Using this latter arrangement, it will be seen that deviation in the strand at the point of leaving the narrow end of the wedge device leads to undue stress concentration in the strand.

The present invention as shown in FIG. 2 reduces this stress concentration in that the side loading produced as a result of the deviated strand tends to cause the strand to follow the line of the cylindrical portion of the opening 2. This causes the unsupported end of the wedge device 5 to be deformed so that the strand, at that point, passes over a relatively gentle curved surface provided by the relieved surface 7 in combination with the deformed end of the wedge device. Furthermore, since the end of the wedge device 5 is relatively thin, it also tends to wrap itself around the strand and supports it over a far greater area than that of the traditional wedge device and hence reduces the radial bearing stresses on the strand.

Although the invention is not limited in this respect, it is preferred that the leading or narrow end of the wedge device 5 should extend into the cylindrical portion 4 by a minimum of 5% of the strand diameter.

I claim:

1. An anchorage assembly for pre-stressed concrete structures, comprising an integral bearing plate having substantially planar end wall and a plurality of transverse openings having parallel axes with each of said openings extending through said planar end wall being adapted to receive a stranded stressing element, and each of said openings, in the position of use in a stressed concrete structure, lying at an angle to the axis of its co-acting stressing element at the point where said stressing element extends out of said bearing plate planar end wall, a frusto-conical wedge device having an axial bore and being positioned between the wall of each of said openings and its co-acting stressing element, each of said openings being in the form of a frusto-conical portion and a cylindrical portion arranged in continuation thereof, said frusto-conical portion forming a major part of the length of said opening and said cylindrical portions of said openings being closely adjacent said end wall, and the relative sizes of each of said openings and its co-acting wedge device being such that the leading or narrow end of said wedge device extends into said cylindrical portion of said opening free of contact therewith.

2. An assembly as claimed in claim 1, in which the extent of said leading or narrow end of said wedge device into said cylindrical portion of said opening is at a minimum equal to 5% of the diameter of said stressing element.

3. An assembly as claimed in claim 1, in which the bore of said wedge device at said leading or narrow end thereof is internally flared.

4. An assembly as claimed in claim 1, in which said wedge device is divided longitudinally into two co-acting parts.

5. An assembly as claimed in claim 1, in which the elements of said wedge device are formed internally with serrations and like gripping means.

6. An assembly as claimed in claim 3, in which that portion of said bore in said leading or narrow end of said wedge device is internally flared.

7. An assembly as recited in claim 6, wherein an extension of said bore flared portion is freely passable through said cylindrical portion to facilitate bending of a strand within said bearing plate at least to the extent permitted by said bore flared portion.

* * * * *